US007240501B2

(12) United States Patent
Bunch et al.

(10) Patent No.: US 7,240,501 B2
(45) Date of Patent: Jul. 10, 2007

(54) SYSTEM FOR PREVENTING CONDENSATION ON REFRIGERATOR DOORS AND FRAMES

(75) Inventors: John Bunch, Phoenix, AZ (US); Bruce G. Malwitz, Buffalo, MN (US); Stephen Maxwell Shelby, Chandler, AZ (US); Matthew Winthur, Gilbert, AZ (US)

(73) Assignee: Door Miser, LLC, Phoenix, AZ (US)

( * ) Notice: Subject to any disclaimer, the term of this patent is extended or adjusted under 35 U.S.C. 154(b) by 0 days.

(21) Appl. No.: 10/778,289

(22) Filed: Feb. 11, 2004

(65) Prior Publication Data

US 2005/0172649 A1 Aug. 11, 2005

(51) Int. Cl.
*A47F 3/04* (2006.01)

(52) U.S. Cl. ..... 62/150; 62/248; 236/51

(58) Field of Classification Search ..... 62/150, 62/140, 275, 248, 175, 279, 155, 234, 276; 236/51

See application file for complete search history.

(56) References Cited

U.S. PATENT DOCUMENTS 3,728,867 A * 4/1973 Jarrett ..... 62/140
4,261,179 A * 4/1981 Dageford ..... 62/150
4,411,139 A * 10/1983 Bos ..... 62/234
4,548,049 A * 10/1985 Rajgopal ..... 62/275
4,750,332 A * 6/1988 Jenski et al. ..... 62/155
5,460,006 A * 10/1995 Torimitsu ..... 236/51
5,542,258 A * 8/1996 Shim ..... 62/150
5,899,078 A 5/1999 Mager
6,453,687 B2 * 9/2002 Sharood et al. ..... 62/127
6,502,409 B1 * 1/2003 Gatling et al. ..... 236/51

* cited by examiner

*Primary Examiner*—Marc Norman
(74) *Attorney, Agent, or Firm*—Etherton Law Group, LLC

(57) ABSTRACT

The present invention is a device for reducing energy consumption by heaters on refrigerator doors and frames. A control unit is set so that the heater is on prior to the formation of condensation. The preferred embodiment provides for preset heater stop and start times entered by a system user. The heater may also be turned on when condensation is sensed by a sensor, and the sensor reading may be used to override the preset times. A programmer provides individual identification of each connected control unit and is used to read, measure and adjust one or more control units' settings. A communications host is used to enable remote monitoring and control. In addition, a quick-disconnect power connector provides for easily setting the system to a heater-on state.

4 Claims, 5 Drawing Sheets

SYSTEM FOR PREVENTING CONDENSATION ON REFRIGERATOR DOORS AND FRAMES

FIELD OF INVENTION

This invention relates generally to refrigeration devices. This invention relates particularly to devices for reducing energy consumption by refrigerator door and frame heaters while maintaining protection against condensation.

BACKGROUND

Shopkeepers display refrigerated or frozen products in temperature-controlled display cases, such as refrigerators with glass display doors or open-air, "coffin," coolers. The refrigerators and freezers are referred to herein as "refrigerators." Changes in temperature and humidity in the surrounding area causes condensation and frost to build up on the refrigerators. This obstructs visibility of the products and can cause unsafe conditions as the condensation falls to the floor. As a result, it is desirable to prevent the build-up of condensation and frost on refrigerators.

To combat condensation and frost, heaters are installed in refrigerator doors and frames, which raise the temperature of the door or frame sufficiently to eliminate condensation. Typically these heaters run constantly, but devices that control whether the heaters are on or off are known in the art. They are referred to generally as anti-sweat controllers. One anti-sweat controller known in the art attaches one or more condensation sensors to the refrigerator door and turns on a door heater when condensation is sensed. Traditionally, a single control box is used to control all the sensors of a given refrigerator. These devices fail, however, to prevent condensation because the heater is not activated until after condensation is sensed. Another version uses a humidistat to sense humidity in the aisle and, when the humidity goes above a given level, the heater is turned on, often regardless of whether condensation is actually present. This increases energy consumption because the heater is either constantly on or turned on unnecessarily. It would be desirable to prevent condensation with the minimum amount of heat, and consequent energy expenditure, necessary.

The anti-sweat controllers known in the art also suffer from the fact that they are hardwired into the local power source, which results in difficult access for repair and replacement because the anti-sweat controllers must be unwired each time they are removed and rewired each time they are reinstalled. If the anti-sweat controller breaks, the fact that the system is integral with the local power source may cause the shopkeeper to be unable to set the system to keep the heaters on until a qualified repairman fixes the problem. Further, the dismantling and reconstruction cause safety issues while obstructing customer access to the refrigerators. It would be desirable to provide an anti-sweat controller that is easier to install, repair and replace and that provides a means for the shopkeeper to mitigate problems if a controller fails.

The controller box controls a number of factors that must be set correctly to reduce energy consumption and eliminate condensation, such as sensitivity of the sensor and how long the heater stays on or off once signaled. To date, these factors have been measured and controlled by manually adjusting various currents and voltages on each control box with a multimeter. For a store with multiple refrigerators and multiple anti-sweat controllers, the multimeter must be plugged into each separate controller in order to adjust the entire system. Detecting the specific location of an electrical failure is frustrating and time consuming due to the need to test each separate device. Balancing the system becomes tedious. As a result, it is desirable to reprogram, monitor, and control an anti-sweat controller system without having to plug into each control box on each refrigerator and without having to make on-site visits to each store.

Therefore, it is an object of this invention to provide door heating where condensation has not yet been detected but is anticipated. It is another object of this invention to provide ease of programming, repair, and reinstallation. It is a further object to provide a system that can be set to a heater-on state if a problem arises with the anti-sweat controller. Another object of this invention is to provide a mobile device that tests and programs all the devices of the system by connecting into only one portion of the system. It is an additional object of the invention to provide remote monitoring and control.

SUMMARY OF THE INVENTION

The present invention is a device for reducing energy consumption by heaters on refrigerator doors and frames. A control unit is set so that the heater is on prior to the formation of condensation. The preferred embodiment provides for preset heater stop and start times entered by a system user. The heater may also be turned on when condensation is sensed by a sensor, and the sensor reading may be used to override the preset times. A programmer provides individual identification of each connected control unit and is used to read, measure and adjust one or more control units' settings. A communications host is used to enable remote monitoring and control. In addition, a quick-disconnect power connector provides for easily setting the system to a heater-on state.

DETAILED DESCRIPTION OF THE INVENTION

Figure 1:
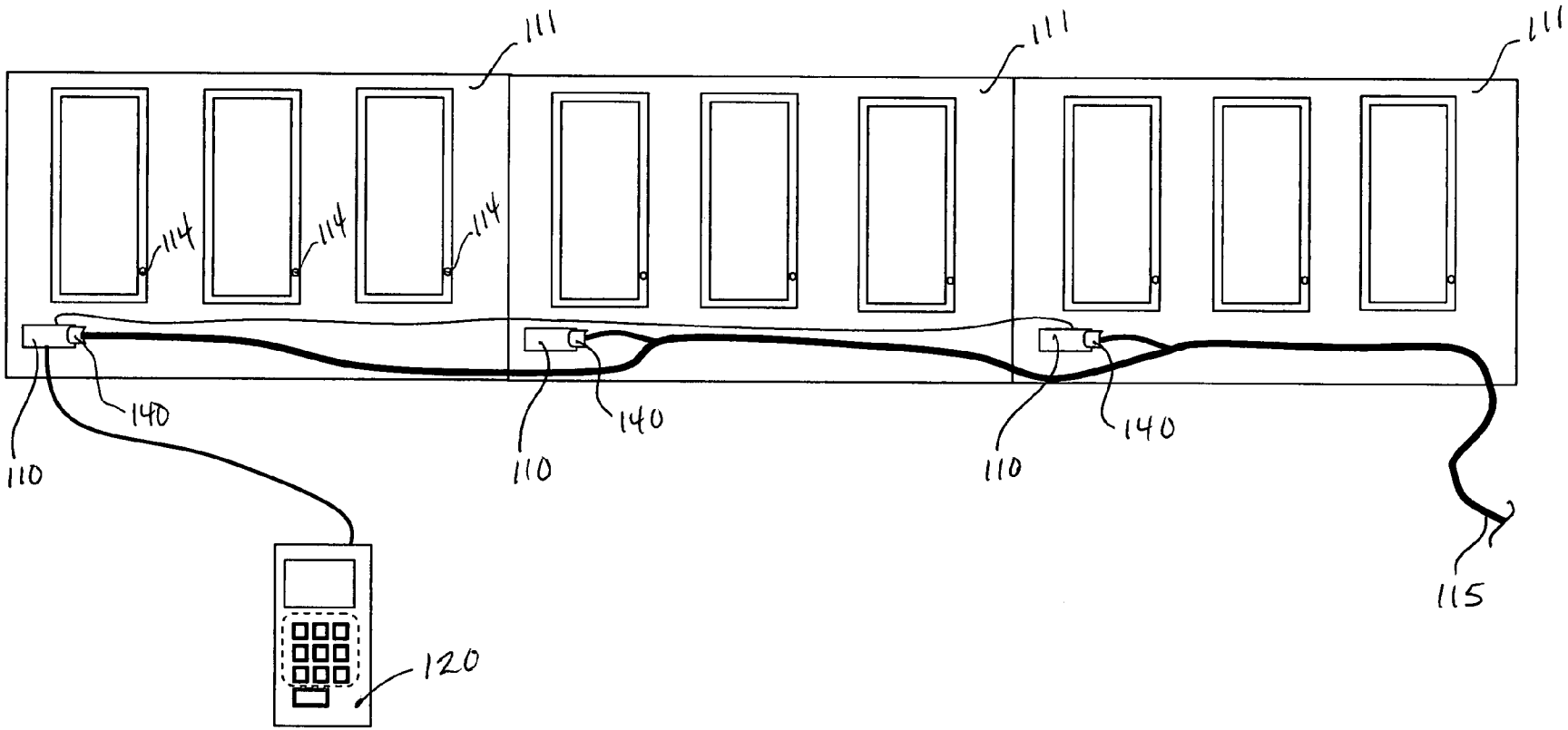
FIG. 1 illustrates an anti-sweat controller installed on a refrigerator according to the present invention.

Referring to FIGS. 1–5, the system comprises a control unit 110, one or more sensors 114, and a programmer 120. The system is used to prevent condensation on the doors and frames of a refrigerator 111 in conjunction with a heater (not shown, but usually incorporated in the door or frame) and a power source 115. Control unit 110 is the means for signaling the heater and preferably provides a means for adjusting and regulating power to the heater. Control unit 110 communicates with the programmer 120, one or more sensors 114, and the power source 115, which also powers the heaters. Preferably, multiple control units 110 are connected to each other, as shown in FIG. 1, allowing for data transmission between the control units 110.

Figure 2:
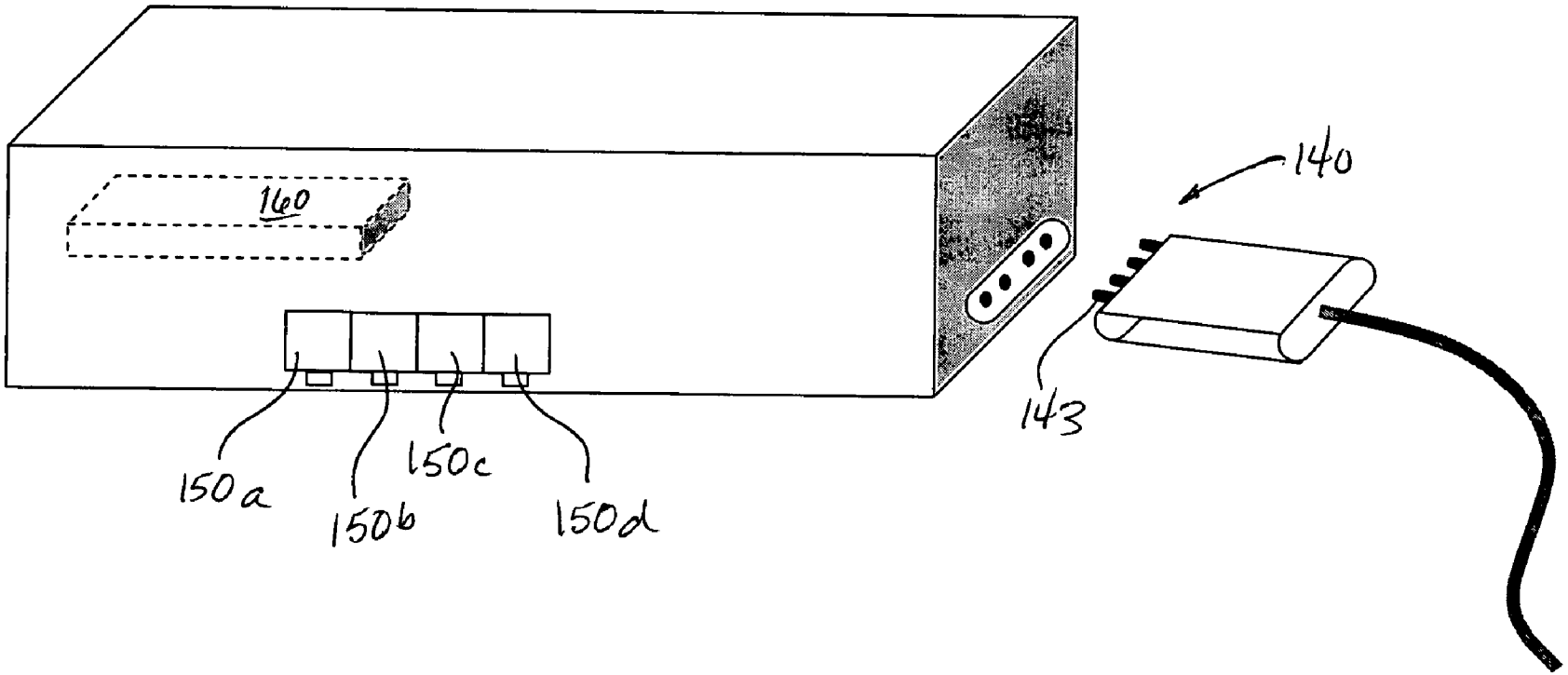
FIG. 2 illustrates a control unit according to the present invention.
Figure 3:
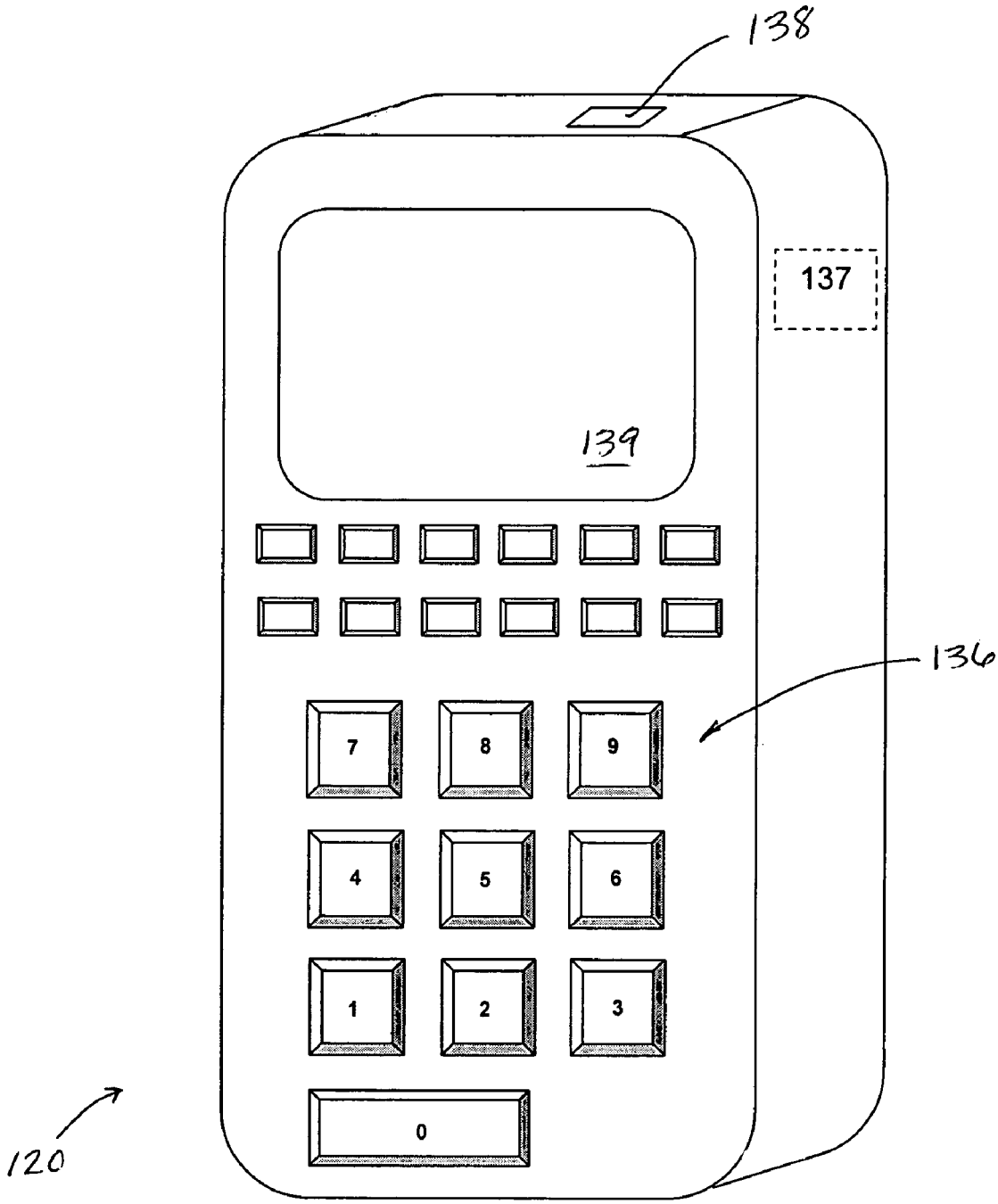
FIG. 3 illustrates the programmer according to the present invention.
Figure 4:
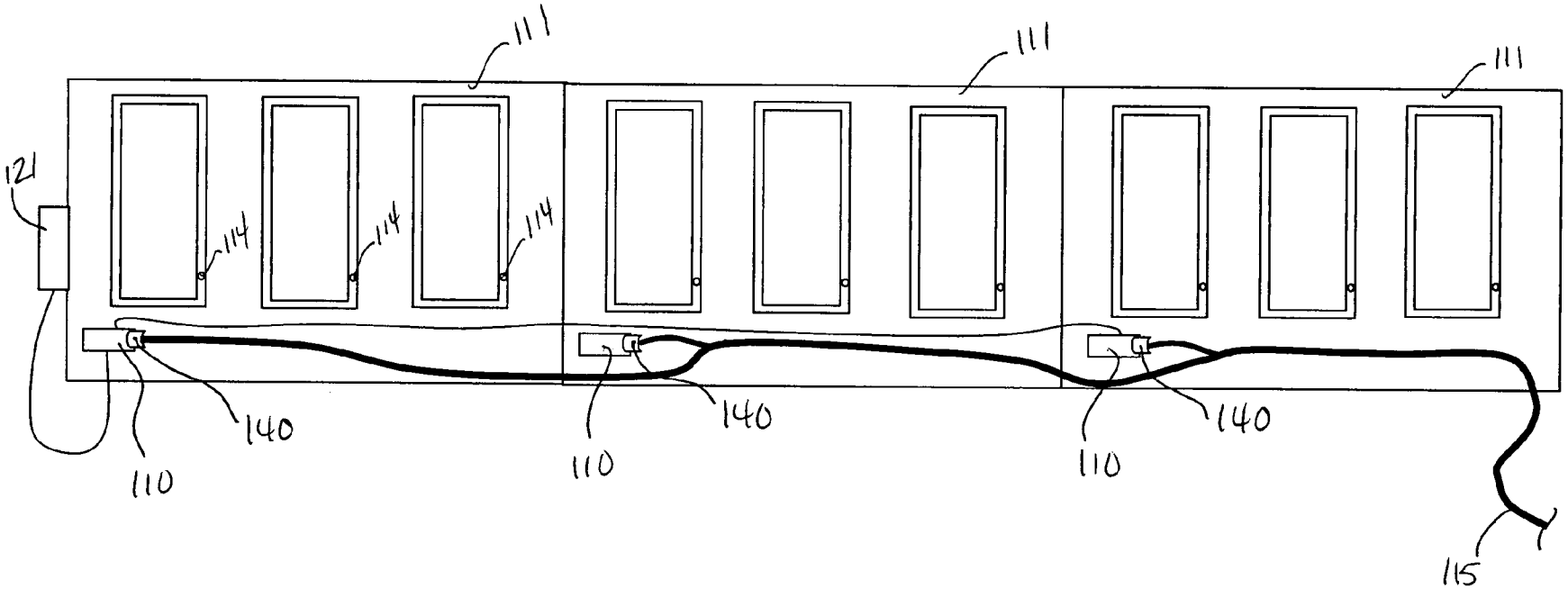
FIG. 4 illustrates a communications host installed on a refrigerator according to the present invention.
Figure 5:
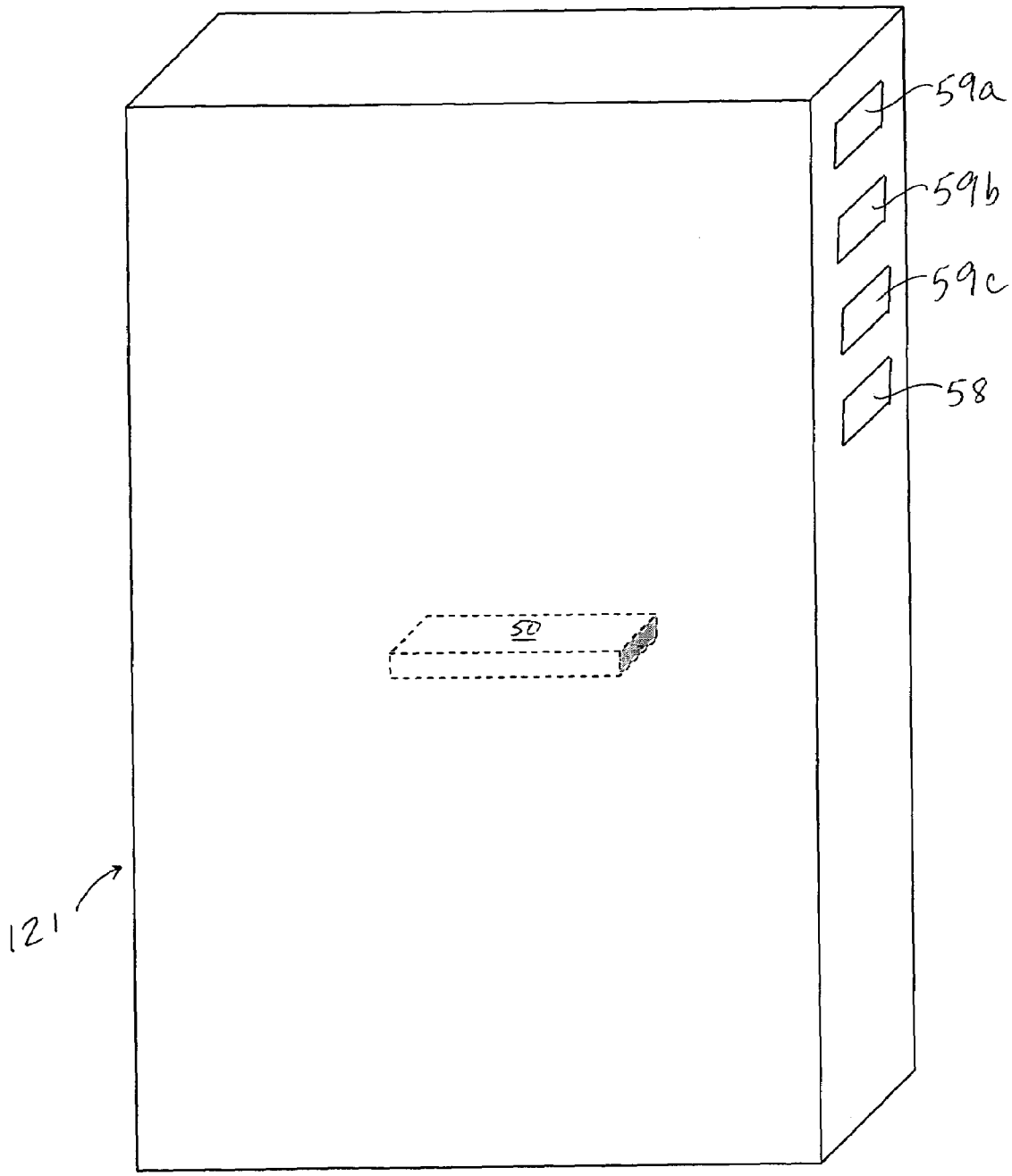
FIG. 5 illustrates the communications host according to the present invention.

In contrast to prior art anti-sweat controllers which relied on discrete components, the present invention utilizes integrated circuits and digital transmissions for increased sensitivity, control, and reliability. For ease of installation with known performance characteristics, control unit 110 preferably uses modular connectors known in the art. In the preferred embodiment, four RJ-12 connectors 150*a*–150*d* are used, as shown in FIG. 2, which allow for transmission to and from heating components (preferably utilizing RJ-12 connector 150*b*), sensors 114 (preferably utilizing RJ-11 connector 150*c*), programmer 120 (preferably utilizing RJ-12 connector 150*b*), other control units 110 (preferably utilizing RJ-12 connectors 150*a* and 150*d*). Control unit 110 preferably further comprises a computer processor 160, preferably a microcontroller that includes a timer, memory and an analog-to-digital converter.

The invention includes one or more condensation sensors 114 that are attached to refrigerator, preferably positioned uniquely for each refrigerator where condensation forms the soonest, such as on the door jams, headers, or mullions. Preferably each sensor is a resistivity sensor in which two parallel conductors are short-circuited when moisture condenses between them, as known in the art. Each sensor is connected to the control unit 110 which detects when condensation starts to form and, in response, applies power to the heater. The system continuously monitors the sensor so that when conditions change such that condensation is no longer present, power to the heaters is turned off.

The programmer 120 is the means for measuring, setting and adjusting certain parameters of one or more control units. See FIG. 3. The programmer preferably comprises a computer processor 137, a signal input/output 138, a keyboard 136, and a display 139. The programmer can identify each control unit 110 separately. A user assigns an identifier, preferably by typing a number into the keyboard, unique to each of the control units 110, sensors 114, and other devices within system. Preferably the control unit 110 can retain its control number in its memory. The ability to identify each control unit 110 separately enables the programmer 120 and communications host 121 to determine if and where electrical failure or maladjustment has occurred, without the user having to separately connect to each device within system. The programmer 120 also reads values measured within system, such as currents, resistances, voltages, loads, set points, and times. Considering issues such as technology, the nature of control unit 110, cost, etc., other values such as capacitance, flux, other electrical measurements, temperatures, volumes, pressures, rates, accelerations, frequencies, cycles, sensitivities, etc., may be read and adjusted. The programmer 120 also adjusts values, such as lowering the set point of the sensor and thereby decreasing sensitivity. For example, if the set point of the sensor is set high, such that the heater is instructed to turn on when very little current is measured between the conductive lines of the sensor, the heater will turn on as the lightest condensation occurs. However, if the sensitivity is set lower, such that the heater turns on only when significantly more current is measured between the conductive lines, the heater will turn on when more condensation is present. Ideally the sensitivity is adjusted to maintain an optimum balance between condensation and the amount of time the heater is on. Of course, the less the heater is on, the less energy is consumed by the system and the lower the energy costs. The programmer is also used to set pre-set stop and start times, as discussed in more detail below, which work in cooperation with the sensor setting. Proper settings enable the shopkeeper to achieve demand savings, i.e., reducing power consumption during higher-rate periods, as well as savings due to overall power consumption. The programmer preferably uses an RJ-12 connector at the signal input/output 138, which allows for electrical transmission to control units 110, and any other component of system.

The system may also comprise a communications host 121 that logs and manages system information and allows a system user to monitor and control a network of control units. See FIGS. 4 and 5. In the preferred embodiment, up to 128 control units can be monitored by a single communications host. With a communications host 121, a user can troubleshoot and monitor, either locally or remotely, each control unit for real-time runtime and loads. Communications host 121 comprises a computer processor, preferably a microcontroller 50, controller box connection 58, and communications ports 59*a*–*c*. Communications host 121 uses the ports 59*a*–*c* to connect to a variety of devices such as a laptop, the internet, or a local area network. In the preferred embodiment, multiple types of ports are provided for, including Ethernet port 59*a*, an RS-232 port 59*b*, and an RJ-11 port 59*c*. Preferably web-based software application allows the user to see runtime and load savings. Communications host 121 is preferably located at the end of a refrigerator aisle, connecting into system utilizing an RS485 connection for controller box connector 58. Communications host 121 preferably uses a battery back-up power supply in the event of power failure.

To anticipate condensation, the control unit 110 signals when the heater should be on prior to the formation of condensation, preferably at pre-set start and stop times consistent with when condensation is anticipated. For example, in the context of supermarket refrigerator doors, pre-set start times could be set to once every hour, on the hour, between 6 a.m. and 9 a.m., 12 p.m. and 1 p.m., and 5 p.m. and 9 p.m. (times corresponding to when: the supermarket is very busy, refrigerator doors are repeatedly opened, and condensation is anticipated). Preferably pre-set stop times are set to provide for 15 minute duty cycles. These preset times work in cooperation with the sensors, and the sensor measurements can override the preset times. For example, in the event the pre-set cycle time is insufficient to prevent condensation, the sensor reading can override the pre-set "off" time and cause the heater to run until no more condensation is detected. The programmer 120 is used to set the preset stop and start times of the control unit 110.

A quick-disconnect coupling 140 connects each control unit 110 to the power source 115. Coupling 140 is preferably a mate and lock connector, with four prongs 143, as shown in FIG. 2. Other quick-disconnect plugs that provide simple, rapid separation of the spliced wires without the use of tools may be used. Coupling 140 enables a shopkeeper to disconnect the control unit 110 from the heaters without unwiring the system, which allows the heaters to revert to their always-on state and prevent condensation until a qualified repairman can fix the system. Coupling 140 also provides for a control unit 110 to be removed and installed much more safely and quickly than prior art devices. Power source 115 is preferably an AC power supply, such as a circuit off of the mains.

While there has been illustrated and described what is at present considered to be the preferred embodiment of the present invention, it will be understood by those skilled in the art that various changes and modifications may be made and equivalents may be substituted for elements thereof without departing from the true scope of the invention. Therefore, it is intended that this invention not be limited to the particular embodiment disclosed, but that the invention will include all embodiments falling within the scope of the appended claims.

I claim:

1. A system for reducing energy consumption by a heater on a refrigerator, the system comprising:

a) a control unit comprising a computer processor; memory; a timer; and an analog-to-digital converter;

b) a quick-disconnect power connector connecting the control unit to a power source;

c) at least one sensor that senses condensation connected to the control unit;

c) a programmer connected to the control unit, wherein the programmer further comprises:

i. a computer processor;

ii. a signal input/output;

iii. a keyboard; and iv. a display, wherein the programmer sets at least one preset time in the control unit to turn off the heater and the control unit receives a signal from a sensor that overrides the preset time such that the heater is turned on; and e) a communications host connected to at least one control unit, wherein the communications host enables remote monitor and control of each control unit.

2. The system according to claim 1 wherein the communications host enables remote monitor and control of the control unit via connection to one of a laptop, the internet, or a local area network.

3. A system for reducing energy consumption by a heater on a refrigerator, the system comprising:

a) a control unit comprising a computer processor; memory; a timer; and an analog-to-digital converter;

b) a quick-disconnect power connector connecting the control unit to a power source;

c) at least one sensor that senses condensation connected to the control unit;

d) a programmer connected to the control unit, wherein the programmer sets at least one preset time in the control unit to turn the heater on or off based on one or more predetermined times of day and the control unit receives a signal from a sensor that overrides the preset time such that the heater is turned on; and e) a communications host connected to at least one control unit, wherein the communications host enables remote monitor and control of each control unit.

4. The system according to claim 3 wherein the communications host enables remote monitor and control of the control unit via connection to one of a laptop, the internet, or a local area network.

* * * * *